US008402702B1

(12) United States Patent
Villaverde

(10) Patent No.: US 8,402,702 B1
(45) Date of Patent: Mar. 26, 2013

(54) ASEISMIC SLIDING ISOLATION SYSTEM USING HYDROMAGNETIC BEARINGS

(76) Inventor: Roberto Villaverde, Irvine, CA (US)

( * ) Notice: Subject to any disclaimer, the term of this patent is extended or adjusted under 35 U.S.C. 154(b) by 31 days.

(21) Appl. No.: 13/317,972

(22) Filed: Nov. 1, 2011

Related U.S. Application Data

(60) Provisional application No. 61/516,315, filed on Apr. 1, 2011.

(51) Int. Cl.
*E04B 1/98* (2006.01)
*E02D 31/08* (2006.01)
*E01D 19/04* (2006.01)

(52) U.S. Cl. ..... 52/167.7; 52/167.4; 52/167.8; 14/73.5; 384/36

(58) Field of Classification Search ..... 14/73.5, 14/74.5, 74, 77.1, 77.3, 78; 52/167.4, 167.7, 52/167.8; 248/206.5; 384/8, 36
See application file for complete search history.

(56) References Cited

U.S. PATENT DOCUMENTS

| | | | | | |
|---|---|---|---|---|---|
| 99,973 | A | | 2/1870 | Touaillon | |
| 3,342,447 | A | * | 9/1967 | Marsh | 248/638 |
| 3,349,418 | A | * | 10/1967 | Hein | 14/73.5 |
| 4,599,834 | A | | 7/1986 | Fujimoto et al. | |
| 4,617,769 | A | | 10/1986 | Fyfe et al. | |
| 4,644,714 | A | | 2/1987 | Zayas | |
| 4,887,788 | A | * | 12/1989 | Fischer et al. | 248/562 |
| 4,978,581 | A | * | 12/1990 | Fukahori et al. | 428/492 |
| 5,181,356 | A | | 1/1993 | Sul | |
| 5,489,180 | A | * | 2/1996 | Ichihara et al. | 411/544 |
| 5,867,951 | A | | 2/1999 | Yaguchi et al. | |
| 5,946,866 | A | * | 9/1999 | Weglewski et al. | 52/167.1 |
| 6,126,136 | A | | 10/2000 | Yen et al. | |
| 6,138,967 | A | * | 10/2000 | Okamoto | 248/188.1 |
| 6,289,640 | B1 | * | 9/2001 | Ueda et al. | 52/167.9 |
| 6,799,400 | B2 | * | 10/2004 | Chuang | 52/167.1 |
| 6,826,873 | B2 | | 12/2004 | Valencia | |
| 6,951,083 | B2 | | 10/2005 | Kim | |
| 6,971,795 | B2 | | 12/2005 | Lee et al. | |
| 7,325,792 | B2 | | 2/2008 | Siino et al. | |
| 7,547,142 | B2 | | 6/2009 | Robinson et al. | |
| 7,814,712 | B2 | | 10/2010 | Tsai | |
| 7,886,489 | B2 | | 2/2011 | Tubota | |
| 2002/0166295 | A1 | | 11/2002 | Shustov | |
| 2005/0100253 | A1 | * | 5/2005 | Chang et al. | 384/36 |
| 2006/0174555 | A1 | | 8/2006 | Zayas et al. | |
| 2007/0044395 | A1 | | 3/2007 | Lu et al. | |
| 2009/0094906 | A1 | | 4/2009 | Sato | |
| 2009/0188179 | A1 | | 7/2009 | Huber et al. | |
| 2010/0095608 | A1 | | 4/2010 | Marioni | |
| 2010/0195942 | A1 | | 8/2010 | Tavecchio | |
| 2012/0097812 | A1 | * | 4/2012 | Zampelli | 248/206.5 |

* cited by examiner

*Primary Examiner* — Brian Glessner
*Assistant Examiner* — Joseph J Sadlon

(57) ABSTRACT

Disclosed is a magnetically controlled base isolation system that in a simple, practical, and cost effective way significantly reduces the lateral forces transmitted to buildings, bridges, and other structures during earthquakes. It comprises sliding bearings that are constructed with steel elements, elastomeric O-rings, and permanent magnets; contain a pressurized fluid; and slide over electricity-conducting metallic base plates. It also comprises permanent magnets disposed at the periphery of the metallic base plates. The pressurized fluid carries the bulk of the vertical load supported by each bearing, minimizing thus the magnitude of the frictional forces that resist the bearings' sliding. The motion of the permanent magnets in the sliding bearings over the electricity-conducting base plates generates damping forces that reduce the bearings' relative displacements to practical levels. The peripheral permanent magnets induce re-centering forces on the bearings and forces that prevent the traveling of the bearings beyond the base plates' boundaries.

14 Claims, 3 Drawing Sheets

ASEISMIC SLIDING ISOLATION SYSTEM USING HYDROMAGNETIC BEARINGS

CROSS-REFERENCE TO RELATED APPLICATIONS

This application claims the benefit of provisional patent application Ser. No. 61/516,315, filed Apr. 1, 2011 by the present inventor.

FEDERALLY SPONSORED RESEARCH

Not applicable

SEQUENCE LISTING OR PROGRAM

Not applicable

BACKGROUND OF THE INVENTION

1. Field of Invention

The disclosed invention relates in general to systems used to isolate structures from earthquake effects and protect them from earthquake damage. In particular, it relates to systems that let structures slide on their foundations during an earthquake as a means to prevent the full transmission to the structures of the ground vibrations generated by the earthquake.

2. Prior Art

Throughout historic times, earthquakes have inflicted destruction and loss of life in population centers around the world. For the most part, the destruction and loss of life is caused by the failure or collapse of man-made structures. The reason for such a failure or collapse is because with traditional construction methods, structures are rigidly connected to the ground upon which they rest. In consequence, the structures are also subjected to the ground vibrations generated by an earthquake. Furthermore, the transmitted vibrations are often amplified by the structures themselves and may thus generate on the structures lateral forces that exceed their capacity to resist these forces.

In an attempt to prevent the aforesaid transmission of ground vibrations during an earthquake, many systems have been suggested to isolate structures from their foundations. One of such systems is based on the use of sliding bearings. In its basic form, a sliding bearing is composed of two steel plates and a low-friction plate or rolling element in between. The bearing is placed between a structure and its foundation, with one of the steel plates connected to the structure and the other plate connected to the foundation. During an earthquake, the foundation slides under the structure, keeping the structure virtually motionless and preventing thus the transmission of the ground vibrations to the structure.

The first of such sliding bearings in record is disclosed in U.S. Pat. No. 99,973, issued in 1870 to J. Touaillon for an invention entitled "Improvement in Buildings." In these sliding bearings, depressions in the shape of a spherical segment are formed in the aforementioned steel plates and spherical balls are inserted between the two plates. The spherical balls rest on the depressions of the foundation plate and are free to move along any horizontal direction. During an earthquake, the spherical balls roll over the foundation plate, allowing the foundation to move in relation to the superstructure.

Although effective to protect structures against the effect of earthquake ground motions, sliding bearings have, nonetheless, some drawbacks. One of these drawbacks is the large relative displacement that may occur between the structure and the foundation during an earthquake. A large relative displacement between a structure and a foundation impacts the size of the gap needed between an isolated building or bridge and neighboring structures or structural elements. It also impacts the complexity of the flexible joints that are required to permit the relative displacement of the service lines that cross the superstructure-substructure interface. Another drawback is the possibility that the structure may not return fully to its original position after an earthquake as a result of the unavoidable friction between the sliding elements. This may affect the performance of an isolated building or bridge during consecutive earthquakes if a prior earthquake leaves the bearings off center and with a reduced space for the sliding of the bearings.

Because of these drawbacks, many different sliding bearings have been proposed throughout the years. For the most part, these different sliding bearings work on the same basic principle described above, but include variations such as the use of cylindrical rollers or low-friction plates such as PTFE (polytetrafluoroethylene) plates instead of spherical balls, the use of curved sliding surfaces instead of flat ones, the use of multiple sliding surfaces instead of just one, and the use of a separate sliding assembly for each of two orthogonal horizontal directions. The overall intention has been to minimize the friction between the sliding elements, provide a re-centering force that can bring back the sliding plates back to their original positions after they are displaced by an earthquake, facilitate an optimum performance of the bearings along orthogonal horizontal directions, and introduce energy dissipation mechanisms.

Examples of sliding bearings that use cylindrical rollers or low-friction PTFE plates are those disclosed in U.S. Pat. Nos. 4,599,834 to Fujimoto et al. (1986); 4,617,769 to Fyfe et al. (1986); 6,289,640 to Ueda et al. (2001); 6,971,795 to Lee et al. (2005); 7,547,142 to Robinson et al. (2009); 7,814,712 to Tsai (2010); 7,886,489 to Tubota (2011); and U.S. patent applications 20020166295 by Shustov (2002); 20090094906 by Sato (2009); and 20100195942 by Tavecchio (2010).

Examples of sliding bearings that use curved sliding surfaces to provide a re-centering force are those suggested in U.S. Pat. Nos. 4,644,714 to Zayas (1987); 5,867,951 to Yaguchi et al. (1999); 6,126,136 to Yen et al. (2000); and U.S. patent application 20070044395 by Lu et al. (2007).

Examples of sliding bearings that use multiple sliding surfaces are those shown in patent applications 20060174555 by Zayas et al. (2006); 20090188179 by Huber, et al. (2009), and 20100095608 by Marioni (2010). Examples of sliding bearings that use a separate sliding assembly for each of two orthogonal horizontal directions are those depicted in U.S. Pat. Nos. 6,951,083 to Kim (2005); 6,971,795 to Lee et al. (2005); 7,325,792 to Siino et al. (2008); and 7,814,712 to Tsai (2010).

In still another variation to the basic sliding bearing described above, the plate connected to the structure and the plate connected to the foundation are separated by a pressurized fluid confined by an O-ring. This way, the relative motion between the plates is restricted only by the viscosity of the fluid and the friction between the O-ring and the supporting plate. Consequently, the friction between the sliding plates is reduced to a minimum value as the shear resistance of a fluid and the sliding resistance of an O-ring with a minuscule bearing area are both very small. Examples of sliding bearings that incorporate such a feature are those proposed in U.S. Pat. Nos. 5,181,356 to Sul (1993) and 6,826,873 to Valencia (2004).

Although the majority of the prior-art sliding bearings are undoubtedly effective at reducing the seismic forces acting on the supported structures, only a few have been implemented into building and bridge construction. The reason is that they are, for the most part, bulky, intricate, unreliable, sensitive to the frequency content of ground motions, or costly. The only exception is the pendulum sliding bearing disclosed in U.S. Pat. No. 4,644,714 issued to V. Zayas in 1987, which has enjoyed a commercial success. In this bearing, the sliding surface has a concave spherical form and the element between the upper and lower plates is an articulated slider coated with a PTFE-based low-friction material. During an earthquake, the supported structure responds as a free pendulum with its motion controlled by the natural frequency of this pendulum and the damping generated by the frictional forces between the sliding elements. Also, as the slider moves along the spherical surface, it causes the supported structure to rise, developing a gravity restoring force that helps bring the structure back to its original position. Thus, the bearing has an inherent ability to re-center the supported structure after it has been displaced by an earthquake.

Despite its commercial success, the pendulum sliding bearing invented by Zayas also possesses several disadvantages. One of these disadvantages is that the bearing has a constant natural oscillation frequency (as opposed to an amplitude-dependent oscillation frequency) and this oscillation frequency can match the low-frequency components of earthquake ground motions, which in some cases may have significant amplitudes (near-fault ground motions, for example). Therefore, resonance between the bearing-supported structure and earthquake ground motions with low frequency components is possible and this may lead to high levels of bearing displacements and floor accelerations.

Another disadvantage is related to the use of PTFE for the coating of some of its sliding surfaces. It is known nowadays that PTFE is a material with a low compressive strength, poor wear resistance, and inferior durability. For this reason, the material is generally mixed with additives to increase its capacity to endure large vertical forces; however, this also increases its friction coefficient.

A further disadvantage is that the restoring force developed in the bearing varies linearly with the sliding displacement and therefore the forces transmitted to the structure also increase with the sliding displacement. To prevent, therefore, the transmission of large forces during strong earthquakes, the sliding displacements are reduced by using materials with a higher coefficient of friction. However, if the coefficient of friction is too high, the bearing may not slide and may not be effective under minor and moderate events; also re-centering of the structure becomes an issue.

BACKGROUND OF THE INVENTION

Objects and Advantages

Accordingly, the objects and advantages of the present invention are:

(a) to provide an aseismic isolation system that is simple, reliable, and inexpensive, and may be built with components that are commercially available and require minimum maintenance;

(b) to provide an aseismic isolation system based on sliding bearings that minimize the frictional forces that resist the bearings' sliding but use no PTFE and is thus unaffected by the low bearing capacity, poor wear resistance, and inferior durability of this material;

(c) to provide an aseismic isolation system that is activated under small lateral forces and is therefore effective under both low- and high-intensity earthquakes;

(d) to provide an aseismic isolation system that provides re-centering forces but without amplifying the low-frequency components of earthquake ground motions;

(e) to provide an aseismic isolation system that provides protection against excessively large sliding displacements without impact effects;

(f) to provide an aseismic isolation system that introduces damping into the system to shorten the sliding displacements but without bulky dampers that take up space or components that wear out or require maintenance; and (g) to provide an aseismic isolation system that does not require an external power source for its operation.

A further object and advantage of the invention is to provide an aseismic isolation system that is compact in size and easy to install. Various other features and advantages of the invention will be apparent to those skilled in the art from the following detailed description and accompanying drawings.

SUMMARY

The present invention comprises an isolation system that significantly reduces the forces transmitted to buildings, bridges, and other structures during earthquakes. It operates on the basis of sliding bearings that use a hydrostatic principle to minimize the friction between the bearings and their base plates, a magnetically induced damping force that reduces the bearings' sliding displacements, and magnetically induced forces that provide a re-centering mechanism and protection against excessively large displacements. The sliding bearings are composed of a steel tube with attached permanent magnets, a steel cap plate, a sealing elastomeric O-ring, and a low-compressibility fluid. The isolation system also includes aluminum base plates and peripheral permanent magnets symmetrically attached to the edges of these base plates.

DRAWINGS

Figures

Figure 1:
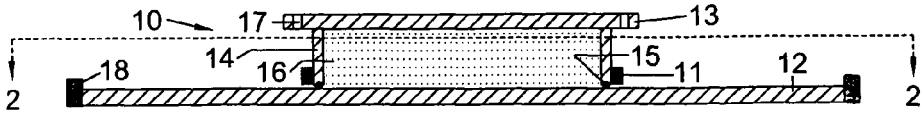
FIG. 1 shows a vertical cross section of the invented isolation system.

| DRAWINGS-Reference numerals | |
|---|---|
| 10 | Hydromagnetic bearing |
| 11 | Central permanent magnet |
| 12 | Aluminum base plate |
| 13 | Welded steel cap plate |
| 14 | Steel tube |
| 15 | Sealing elastomeric O-ring |
| 16 | Low-compressibility fluid |

-continued

| DRAWINGS-Reference numerals | |
|---|---|
| 17 | Cap plate anchoring hole |
| 18 | Peripheral permanent magnet |
| 19 | Cap plate orifice |
| 20 | Auxiliary pipe |
| 21 | Auxiliary pipe seal cap |
| 22 | Pressure gauge |
| 23 | Beam |
| 24 | Floor slab |
| 25 | Column |
| 26 | Anchored steel plate |
| 27 | Footing |
| 28 | Bridge pier |
| 29 | Pier cap |
| 30 | Bridge girder |
| 31 | Decreasing repulsive force |
| 32 | Increasing repulsive force |

DETAILED DESCRIPTION

Figure 2:
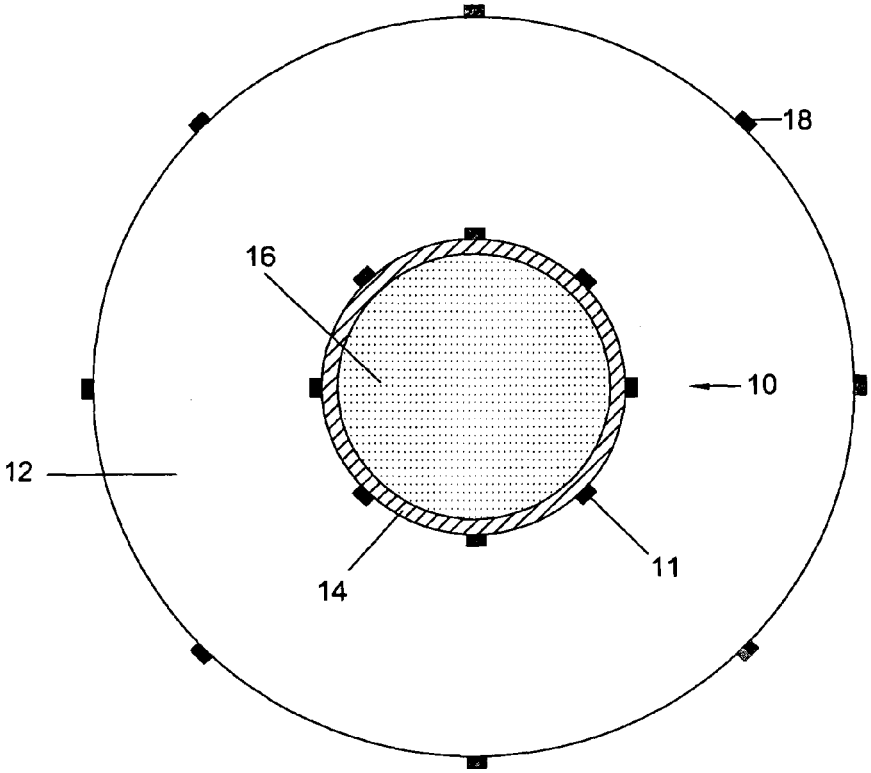
FIG. 2 shows a horizontal cross section through the isolation system, as seen from above.
Figure 3:
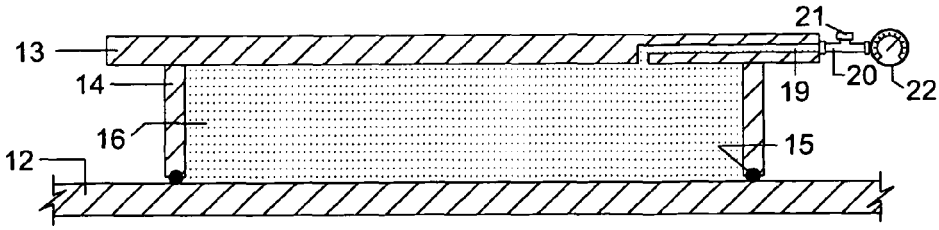
FIG. 3 shows the fluid chamber formed with the components of the isolation system and the way a pressure gage is connected to it.
Figure 4:
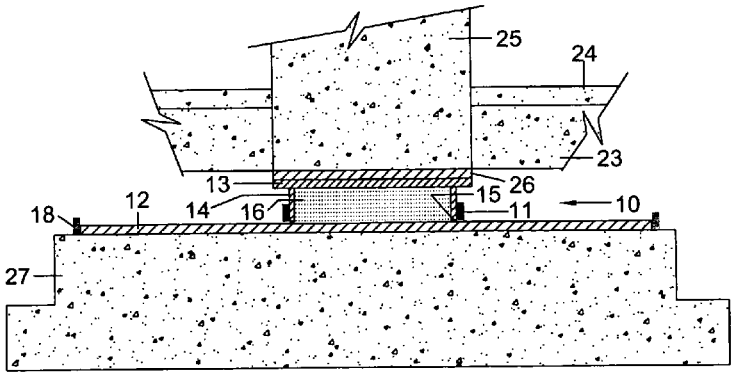
FIG. 4 shows a vertical cross section of the isolation system installed on the footing of a building and connected to the column, beam, and floor slab it supports.
Figure 5:
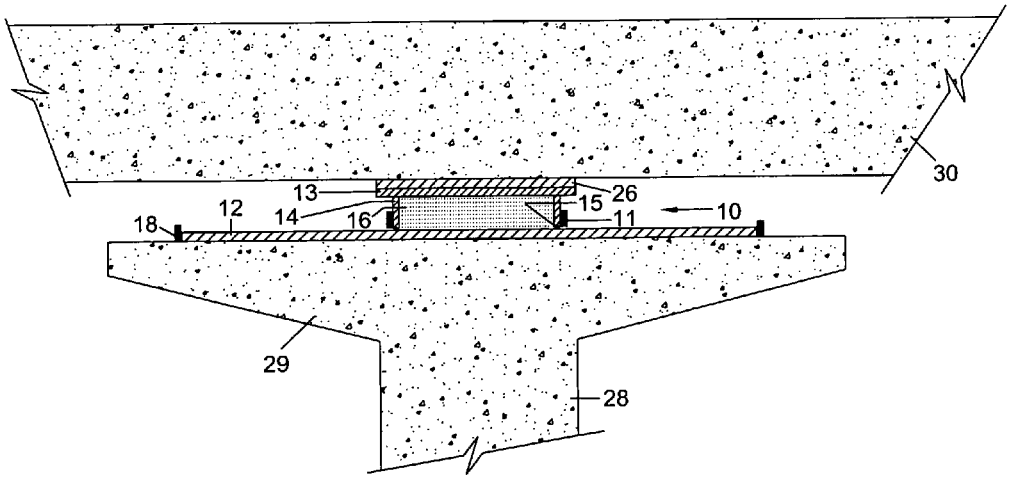
FIG. 5 shows a vertical cross section of the isolation system installed on the pier cap of a bridge pier and connected to the bridge girder it supports.

The invented isolation system is described in FIGS. 1 through 5. FIG. 1 shows a vertical cross section of the isolation system. FIG. 2 shows a horizontal cross section through the isolation system, as seen from above. FIG. 3 shows the fluid chamber formed with the isolation system components and the way a pressure gage 22 is connected to it. FIG. 4 shows a vertical cross section of the isolation system installed on the footing 27 of a building and connected to the column 25, beam 23, and floor slab 24 it supports. FIG. 5 shows a vertical cross section of the isolation system installed on the pier cap 29 of a bridge pier 28 and connected to the bridge girder 28 it supports. As shown in FIGS. 1 and 2, the isolation system under a building column or bridge girder is comprised of a hydromagnetic bearing 10, an aluminum base plate 12, and peripheral permanent magnets 18. The hydromagnetic bearing 10 is composed of a steel tube 14, a steel plate 13 welded to the top of the steel tube 14, permanent magnets 11 equally spaced and symmetrically attached to the exterior lateral surface of the steel tube 14, a sealing elastomeric O-ring 15, and a low-compressibility fluid 16. It rests freely on top of the aluminum base plate 12.

Using the anchoring holes 17 in it, the steel cap plate 13 is bolted to a steel plate 26 anchored to the inferior face of the column or girder being supported by the bearing (see FIGS. 4 and 5). Also, a groove is formed into the lower surface of the steel tube 14, fitting the elastomeric O-ring 15 into it. The groove depth is such as to let the O-ring 15 protrude beyond the lower surface of the steel tube 14. The elastomeric O-ring 15 is of the X-shape type to provide twice the sealing surface in comparison to a standard O-ring and require thus less downward pressure to get an effective seal. The base plate 12 is made of aluminum, but it may also be made of any other metal that is a good electrical conductor. Examples are silver, copper, gold, and tungsten. Aluminum is the preferred metal because it is a good electrical conductor and is widely used as a structural material.

Together, the steel tube 14, the welded steel plate 13, the base plate 12, and the elastomeric O-ring 15 form a hermetic fluid chamber (see FIG. 3). The low-compressibility fluid 16 is contained in this fluid chamber. A small orifice 19 is made into the steel cap plate 13 to be able to pour or extract fluid from the fluid chamber. To this end, an auxiliary pipe 20 with an outlet and a seal cap 21 is connected to this orifice. Also, a pressure gage 22 is attached to the auxiliary pipe 20 to monitor the pressure in the fluid chamber. During the construction of the structure supported by the bearing, it is advisable to take out small amounts of the fluid from the fluid chamber as the weight supported by the bearing increases. The purpose is to compress the O-ring 15, increase the sealing surface, and obtain an effective seal under an increasing fluid pressure. The aluminum plate 12 is polished to a mirror finish to minimize the possibility of fluid leaks and minimize the friction between the plate and the elastomeric O-ring 15. The low-compressibility fluid 16 may be any oil as long as it is compatible with the elastomer with which the O-ring 15 is made.

As shown in FIG. 2, the central permanent magnets 11 are attached symmetrically and equally spaced to the exterior lateral surface of the steel tube 14. Similarly, the peripheral permanent magnets 18 are disposed symmetrically and equally spaced at the edge of the aluminum plate 12. Their orientation is such as to produce repulsive forces on each other. As magnets cannot be drilled or welded, they are fastened to the steel tube 14 and the aluminum plate 12 using mechanical means (e.g., clamps). The preferred shape of the magnets is that of a circular segment (arc magnets) if the steel tube 14 and the aluminum plate 12 have circular shapes. However, magnets in the form of a rod, disk, ring, cylinder or sphere may also be used. The type used for both the central 11 and peripheral 18 permanent magnets is preferably the neodymium-iron-boron type, although any other suitable type may be used. Neodymium-iron-boron magnets provide high strength per unit volume, so they are ideal for compact designs at low cost. Neodymium-iron-boron magnets of different grades, sizes, and shapes are available from Magnet Sales & Manufacturing Inc. of Culver City, Calif.

Operation

In a sliding bearing constructed according to the invention, the vertical load transmitted to the bearing by a building column or bridge girder is shared by the elastomeric O-ring 15 and the low-compressibility fluid 16 according to the relative values of their bulk moduli. But the bulk modulus of the low-compressibility fluid 16 is much higher than the bulk modulus of the O-ring 15. Also, the fluid is hermetically contained in the fluid chamber formed by the steel tube 14, the welded steel plate 13, the base plate 12, and the O-ring 15 so it is not possible for the low-compressibility fluid 16 to flow out of the fluid chamber. Therefore, most of the aforesaid vertical load is supported by the fluid in the fluid chamber through an increase in the fluid pressure. If it is considered, in addition, that a fluid presents little resistance to shearing forces, then the only de facto resistance to the sliding of the bearing under the action of a horizontal force is the resistance offered by the frictional force between the O-ring 15 and the base plate 12. However, this friction force is not too large since the normal force acting on the O-ring 15 is small and the base plate 12 is highly polished. Consequently, if no other forces are involved, the bearing 10 is virtually unrestricted to slide back and forth over its base plate 12.

In a sliding bearing constructed according to the invention, there are also other forces involved that, to some extent, restrict the motion of the bearing. These other forces are introduced to overcome the main disadvantages of sliding isolation systems. Namely, the fact that they can be subjected to impractically large relative displacements, and the lack of restoring forces to bring the bearings back to their original position after an earthquake. The first of the other forces that restrict the motion of the bearing in the invented isolation system is a damping force generated by the motion of the sliding bearing 10 over the aluminum base plate 12. This force appears and slows down (damps) the motion of the sliding bearing 10 because:

The central permanent magnets 11 generate a magnetic field in their surrounding space When the permanent magnets 11 are in motion, the intensity of the generated magnetic field at a given point in space changes with time According to Faraday's law, a changing magnetic field induces in a nearby conducting material electrical eddy currents Aluminum is an electricity-conducting material According to Biot and Savart's law, these eddy currents induce, in turn, a secondary magnetic field in the surrounding space of the conducting material According to Lenz's law, this secondary magnetic field generates forces on the permanent magnets 11 that resist and slow down their motion It should be noted that the magnitude of the damping force just described depends on the number, size, and grade of the permanent magnets 11 and the thickness of the aluminum plate 12. The amount of damping introduced into the isolation system may be thus controlled by changing some or all of these parameters. It should also be noted that a damping force reduces the peak relative displacement of a bearing during an earthquake in comparison with the peak relative displacement that would be observed in a similar bearing but without a damping mechanism. However, such a reduction is realized at the cost of increasing the vibrations transmitted from the ground to the superstructure. Thus, the amount of damping introduced into the invented isolation system should be such that, on one hand, reduces the bearing's peak relative displacement to an acceptable level and, on the other hand, does not increase excessively the vibrations transmitted to the superstructure.

Figure 6:
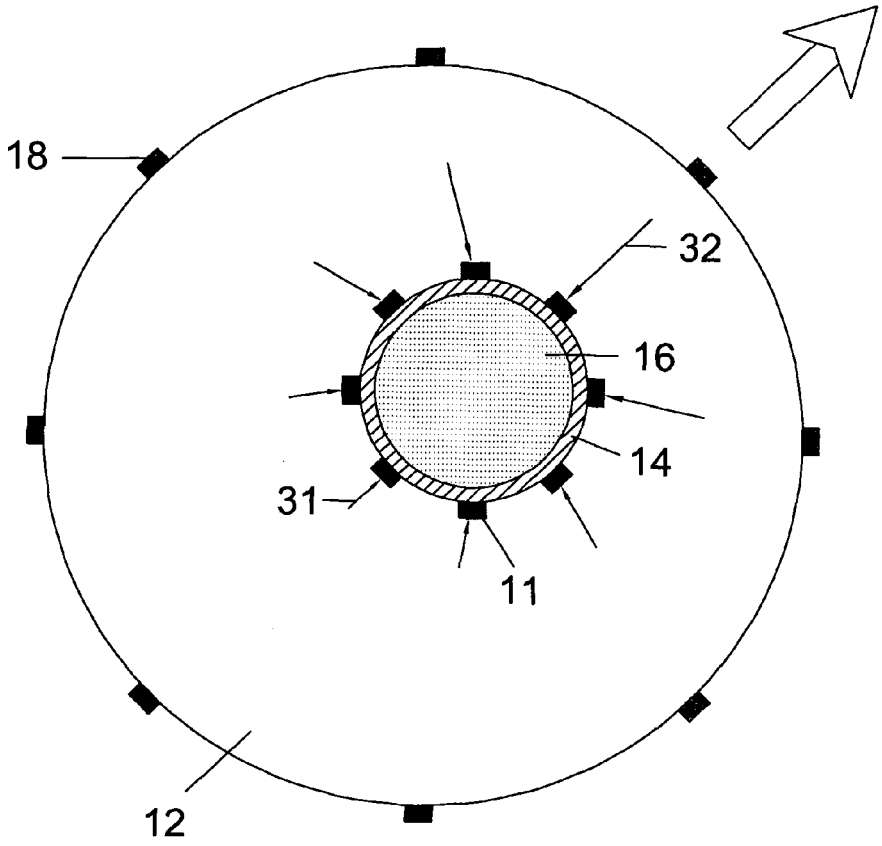
FIG. 6 shows a plan view of the isolation system after the system's bearing is displaced from its central position and the forces exerted on the bearing by peripheral permanent magnets.

The second other force that restricts the motion of the bearing in the invented isolation system is the resultant of the repulsive forces 31 and 32 on the permanent magnets 11 exerted by the peripheral permanent magnets 18 (see FIG. 6). These repulsive forces arise because of the well-known fact that the like poles of two magnets repel each other, and because, as installed, the like poles of the peripheral permanent magnets 18 and the central permanent magnets 11 always face each other. The magnitude of the repulsive forces 31 and 32 and, hence, the magnitude of the resultant force acting on the sliding bearing 10 depends on the strength of the magnets, their number, their size, and the distance between them. For a given set of magnets with given strength, number, and size, the magnitude and direction of the resultant force acting on the sliding bearing 10 depend thus on its position relative to its initial central position (see FIG. 6). Because of the symmetrical arrangement of the central 11 and the peripheral permanent magnets 18, the resultant of the repulsive forces 31 and 32 on the sliding bearing 10 is zero when it is in its central position. However, if the sliding bearing 10 is displaced from its central position, some of the repulsive forces will increase and some others will decrease. In this case, therefore, the resultant of the repulsive forces will be a force that opposes the motion of the sliding bearing 10 and will bring it back to its central position in the absence of any other external forces (see FIG. 6, where the white arrow indicates the direction of the bearing's relative motion).

As the magnitude of the repulsive force between two magnetic poles decays rapidly with distance, the force opposing the motion of the sliding bearing 10 (restoring force) will be small if the bearing 10 is near the center of the base plate 12, but it will be a strong one if it is near its edge. This offers the double advantage of allowing the bearing 10 to displace more or less freely under earthquakes that are equal or smaller than the design earthquake, but restricting its motion in the event of unexpectedly large earthquake. It should be noted, however, that, as in the case of the aforementioned damping force, a restoring force is transmitted to the super-structure. The restoring force generated by the permanent magnets should be thus the minimum that is required to bring the sliding bearing 10 back to its original position after an earthquake. In this regard, it is worthwhile to note that in the case of the invented isolation system this minimum restoring force is not a large one because: (a) the force that needs to be overcome for the re-centering of the bearing 10 is the frictional force between the O-ring 15 and the aluminum plate 12, and (b) this frictional force is, as stated earlier, a small one.

The invented sliding isolation system operates thus on the basis of bearings that use a pressurized fluid to support a large portion of the vertical loads and minimize thus the sliding friction between the bearings and their base plates; central permanent magnets that induce damping forces and reduce the bearings' peak relative displacements; and peripheral permanent magnets that generate re-centering forces and forces that prevent the traveling of the bearings beyond the base plates' boundaries. If installed under the columns of a building or the main girder of a bridge, the ground and the substructure of the building or bridge will slide under the superstructure during an earthquake, leaving the building superstructure or bridge substructure virtually unaffected by the earthquake. Furthermore, it operates (a) with a device that is simple and inexpensive to construct, (b) with components that are commercially available and require minimum maintenance, (c) without the need for an external power source, (d) without the need for bulky dampers that take up space or components that wear out or require maintenance, (e) with a built-in protection against unexpectedly large sliding displacements, (f) with no impact effects, and (g) without the possibility of resonance effects with the low-frequency components of earthquake ground motions.

CONCLUSION, RAMIFICATIONS, AND SCOPE

The disclosed invention provides an aseismic sliding isolation system that is simple and reliable, is compact in size and easy to install, requires minimum maintenance, may be built at a low cost with components that are commercially available, and overcomes the limitations of other sliding isolation systems. It is suitable to be used in practically all types of buildings (e.g., residential buildings, commercial buildings, and industrial facilities), bridges, and other structures such as historical monuments, liquid storage tanks, and electrical equipment in electric power substations.

Even though the characteristics and advantages of the invention have been set forth in the foregoing description, together with details of the structure and function of the invention, they are used and are to be interpreted in a generic and descriptive sense only and should not be construed as a limitation on the scope of the invention. Many other ramifications and variations are possible within the main concept of the invention. For example, changes may be made in matters of shape, size, materials, number of components used, and the arrangement of parts. Thus, the scope of the invention should be determined by the broad general meaning of the terms in the appended claims and their legal equivalents.

I claim:

1. A magnetically controlled sliding isolation system for protecting buildings, bridges, and other structures against earthquake damage, comprising:

(a) an electricity-conducting metallic plate of predetermined shape and dimensions to serve as a base plate and furnish a sliding surface, attached in a horizontal position by conventional means to a foundation of a structure at each location where said foundation supports a structural member;

(b) a sliding bearing disposed at each of said locations between lower ends of said structural members and the upper surfaces of said base plates and set so as to be able to slide on said base plates, each comprising:

(1) a steel tube with a predetermined cross section, height, and wall thickness;

(2) a steel plate of predetermined shape, size, and thickness welded to the upper end of said tube to serve as a cap to said steel plate and the bearing's anchoring element;

(3) a circular groove made into an underside surface of said tube;

(4) a sealing elastomeric O-ring fitted into said circular groove, with part of it protruding beyond said underside surface;

(5) a low-compressibility fluid hermetically contained in a fluid chamber formed by said steel tube, said steel cap plate, said elastomeric O-ring, and said base plate; and (6) a plurality of permanent magnets of predetermined shape, size, and type attached to and arranged symmetrically and equally spaced on an exterior lateral surface of said tube;

(c) mounting steel plates of predetermined shape and dimensions connected by conventional means to said cap plates and underside surfaces of the structural members being supported by said bearings; and (d) a plurality of permanent magnets of predetermined shape, size, and type fastened to and arranged symmetrically and equally spaced at an edge of each of said base plates, oriented in such a way as to produce repulsive forces on the permanent magnets attached to said tubes;

whereby a structure may slide laterally relative to its foundation with insignificant resistance in the event of an earthquake, but at the same time limiting to practical levels the relative lateral displacements said structure may experience during said earthquake and gene-rating forces that prevent the traveling of said structure beyond the boundaries of said base plates and re-center said structure after said earthquake stops, achieving all this in a simple, practical, and cost-effective way.

2. The sliding isolation system of claim 1 wherein said steel cap plates are fabricated with a small orifice that extends from a point on their lower surfaces to a point on their lateral surfaces to be able to pour or extract fluid from said fluid chambers.

3. The sliding isolation system of claim 2, further including a pressure gage connected through an auxiliary pipe to said orifices in each of said steel cap plates to be able to monitor the pressure inside said fluid chambers.

4. The sliding isolation system of claim 1 wherein said O-rings are of the X-shape type to provide twice the sealing surface in comparison to a standard O-ring and necessitate less downward pressure to effectively seal said fluid chambers.

5. The sliding isolation system of claim 1 wherein the upper surfaces of said base plates are polished to a mirror finish to reduce the friction between said base plates and said elastomeric O-rings and the possibility of fluid leaks from said fluid chambers.

6. The sliding isolation system of claim 1 wherein said central and peripheral permanent magnets are selected from a group comprising arc, rod, disk, ring, cylindrical, and spherical permanent magnets.

7. The sliding isolation system of claim 1 wherein said central and peripheral permanent magnets are of the neodymium-iron-boron type to be able to set strong magnetic fields with relatively small magnets.

8. A method for isolating buildings, bridges, and other structures from their foundations and protecting them against earthquake damage, comprising the steps of:

(a) providing an electricity-conducting metallic plate of predetermined shape and dimensions to serve as a base plate and furnish a sliding surface, attached in a horizontal position by conventional means to a foundation of a structure at each location where said foundation supports a structural member;

b) providing a sliding bearing at each said location disposed between lower ends of said structural members and the upper surfaces of said base plates and set so as to be able to slide on said base plates, each comprising:

(1) a steel tube with a predetermined cross section, height, and wall thickness;

(2) a steel plate of predetermined shape, size, and thickness welded to an upper end of said tube to serve as a cap to it and the bearing's anchoring element;

(3) a circular groove made into an underside surface of said tube;

(4) a sealing elastomeric O-ring fitted into said circular groove, with part of it protruding beyond said underside surface;

(5) a low-compressibility fluid hermetically contained in an fluid chamber formed by said tube, said cap plate, said elastomeric O-ring, and said base plate; and (6) a plurality of permanent magnets of predetermined shape, size, and type attached to and arranged symmetrically and equally spaced on an exterior lateral surface of said tube;

c) attaching by conventional means mounting steel plates of predetermined shape and dimensions to an underside surfaces of the structural members being supported by said bearings;

d) connecting by conventional means said cap plates to said mounting plates;

e) providing a plurality of permanent magnets of predetermined shape, size, and type fastened to and arranged symmetrically and equally spaced at an edge of each of said base plates, oriented in such a way as to produce repulsive forces on the permanent magnets attached to said tubes;

whereby a structure may slide laterally relative to its foundation with insignificant resistance in the event of an earthquake, but at the same time limiting to practical levels the relative displacements said structure may experience during said earthquake and generating forces that prevent the traveling of said structure beyond the boundaries of said base plates and re-center said structure after said earthquake stops, achieving all this in a simple, practical, and cost-effective way.

9. The method of claim 8 wherein said steel cap plates are fabricated with a small orifice that extends from a point on their lower surfaces to a point on their lateral surfaces to be able to pour or extract fluid from said fluid chambers.

10. The method of claim 9, further including a pressure gage connected through an auxiliary pipe to said orifices in each of said steel cap plates to be able to monitor the pressure inside said fluid chambers.

11. The method of claim 8 wherein said O-ring is of the X-shape type to provide twice the sealing surface in comparison to a standard O-ring and necessitate less downward pressure to effectively seal said fluid chambers.

12. The method of claim 8 wherein the upper surfaces of said base plates are polished to a mirror finish to reduce the friction between said plates and said elastomeric O-rings and the possibility of fluid leaks from said fluid chambers.

13. The method of claim 8 wherein said central and peripheral permanent magnets are selected from a group comprising arc, rod, disk, ring, cylindrical, and spherical permanent magnets.

14. The method of claim 8 wherein said central and peripheral permanent magnets are of the neodymium-iron-boron type to be able to set strong magnetic fields with relatively small magnets.

* * * * *